US010934128B2

(12) United States Patent
Manson

(10) Patent No.: US 10,934,128 B2
(45) Date of Patent: Mar. 2, 2021

(54) AUTOMATED COILING SYSTEM FOR POST-TENSION TENDON

(71) Applicant: Suncoast Post-Tension, Ltd., Houston, TX (US)

(72) Inventor: William B. Manson, Houston, TX (US)

(73) Assignee: Suncoast Post Tension, Ltd., Houston, TX (US)

( * ) Notice: Subject to any disclaimer, the term of this patent is extended or adjusted under 35 U.S.C. 154(b) by 252 days.

(21) Appl. No.: 15/952,043

(22) Filed: Apr. 12, 2018

(65) Prior Publication Data

US 2018/0370754 A1 Dec. 27, 2018

Related U.S. Application Data

(60) Provisional application No. 62/484,749, filed on Apr. 12, 2017.

(51) Int. Cl.

| | |
|---|---|
| ***B65H 75/36*** | (2006.01) |
| ***E04C 5/08*** | (2006.01) |
| ***E04C 5/01*** | (2006.01) |
| ***B65H 54/82*** | (2006.01) |
| ***B65H 54/56*** | (2006.01) |
| ***B65H 54/62*** | (2006.01) |

(52) U.S. Cl.

CPC ..... *B65H 75/364* (2013.01); *B65H 54/56* (2013.01); *B65H 54/62* (2013.01); *B65H 54/82* (2013.01); *E04C 5/015* (2013.01); *E04C 5/08* (2013.01)

(58) Field of Classification Search

CPC ..... B65B 27/06; B65B 11/025

USPC ..... 100/12, 5, 27

See application file for complete search history.

(56) References Cited

U.S. PATENT DOCUMENTS

| | | | | |
|---|---|---|---|---|
| 3,583,311 | A * | 6/1971 | Hill | B21C 47/24 100/7 |
| 3,973,600 | A * | 8/1976 | Choromokos | B21F 3/00 140/1 |
| 6,546,852 | B1 * | 4/2003 | Mazzoni | B65B 27/06 100/2 |
| 8,561,530 | B2 * | 10/2013 | Imai | B65H 65/005 100/15 |
| 2003/0006873 | A1 * | 1/2003 | Weissbrod | B65H 75/22 336/221 |
| 2016/0325861 | A1 * | 11/2016 | Uemoto | B65B 13/02 |
| 2017/0121043 | A1 * | 5/2017 | Wiid | B65H 49/08 |
| 2017/0174372 | A1 * | 6/2017 | Quinones | B65B 65/006 |

FOREIGN PATENT DOCUMENTS

| | | | | |
|---|---|---|---|---|
| WO | WO-9512525 | A1 * | 5/1995 | B65B 27/06 |

* cited by examiner

*Primary Examiner* — Adam J Eiseman
*Assistant Examiner* — Bobby Yeonjin Kim
(74) *Attorney, Agent, or Firm* — Warner J. Delaune; Phelps Dunbar LLP

(57) ABSTRACT

An automated coiling system for post-tension tendons, comprising a frame, a tendon feed device adapted to introduce a tendon of widely varying length into a coiler assembly, a coiler assembly adapted to grip and coil the tendon within a fixed volume having a predefined diameter; a plurality of wire tying devices adapted to securely tie a wire around the tendon bundle of widely varying diameter in a plurality of predetermined positions and cut the wire after tying; and a tendon ejector device adapted to urge a tied tendon bundle from the coiler assembly.

9 Claims, 11 Drawing Sheets

AUTOMATED COILING SYSTEM FOR POST-TENSION TENDON

CROSS-REFERENCE TO RELATED APPLICATIONS

This application claims the benefit under 35 U.S.C. § 119 of provisional application, U.S. Ser. No. 62/484,749, filed on Apr. 12, 2017.

BACKGROUND OF THE INVENTION

1. Field of the Invention

The invention relates generally to devices and methods used to prepare tendon used for post-tension reinforcement of concrete elements, and more particularly to such devices and methods which automate the cutting, coiling, and tying of such tendons into individual units prior to job site delivery.

2. Description of Related Art

Post-tensioning is the reinforcement methodology of choice for slab-on-ground, elevated slab applications and more. This engineered solution creates cast-in-place, pre-stressed concrete by tensioning the reinforcing concrete after the concrete has been placed. In unbonded post-tension construction, tendons are placed prior to concrete placement, and once the concrete reaches a specific initial compressive strength, the tendons are stressed to a specified force and anchored. Post-tensioning's external compressive force makes the concrete more resistant to the tensile stresses that would otherwise cause a concrete element (beam, slab or other member) to pull apart and crack.

Post-tensioning offers the builder a number of advantages, namely: (a) greater flexibility of design, because engineers can flexibly meet any geometric floor plan shape and use varying section dimensions in the floor plan; (b) reduced costs, because post-tension technology enables post-tensioned slabs to be constructed of a reduced volume of concrete, thereby reducing the builder's costs and providing a more economical solution; (c) adaptability to most soil conditions, because post-tensioning is an appropriate method of foundation reinforcement for stable soils and highly expansive soils alike; (d) reinforcement for a variety of applications, because post-tensioning is the reinforcement method of choice for both residential slab-on-ground and elevated floor slab applications, including single family homes, industrial floors, and high rise buildings; and (e) LEED points for green building initiatives, in that use of post-tensioning materials can add LEED (Leadership in Energy and Environmental Design) points toward a Green Building Certification in accordance with the U.S. Green Building Council's rating system.

SUMMARY OF THE INVENTION

An automated coiling system for post-tension tendon is provided, comprising a frame; a tendon feed device adapted to introduce a tendon into a coiler assembly; a coiler assembly adapted to grip and coil the tendon within a fixed volume having a predefined diameter; a plurality of wire tying devices adapted to securely tie a wire around the tendon bundle of widely varying diameter in a plurality of predetermined positions and cut the wire after tying; and a tendon ejector device adapted to urge a tied tendon bundle from the coiler assembly.

The above and other objects and features of the present invention will become apparent from the drawings, the description given herein, and the appended claims.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Figure 1:
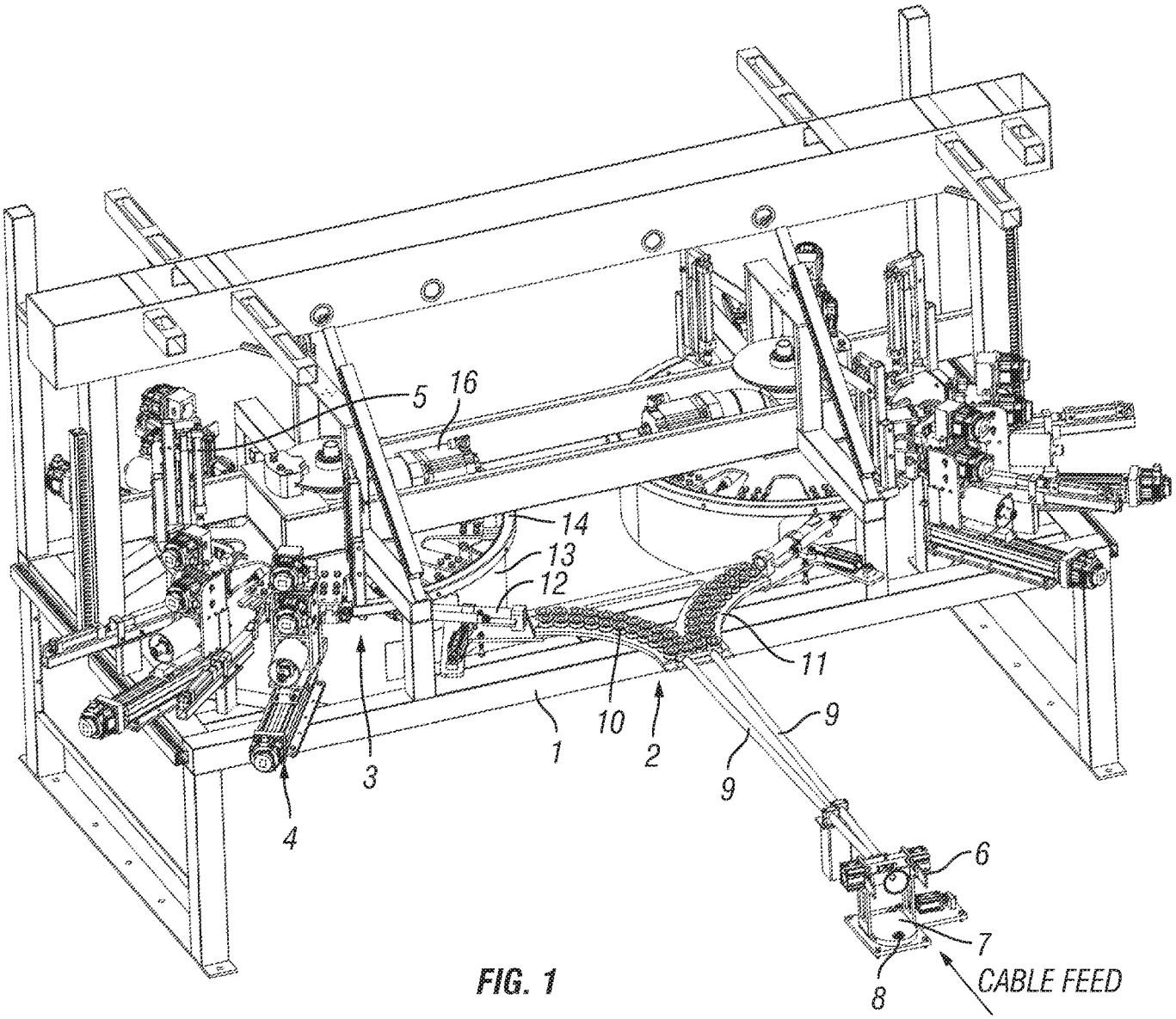
FIG. 1 illustrates a perspective view of a preferred embodiment of the present invention in the form of an automated coiling system for post-tension tendons.
Figure 2:
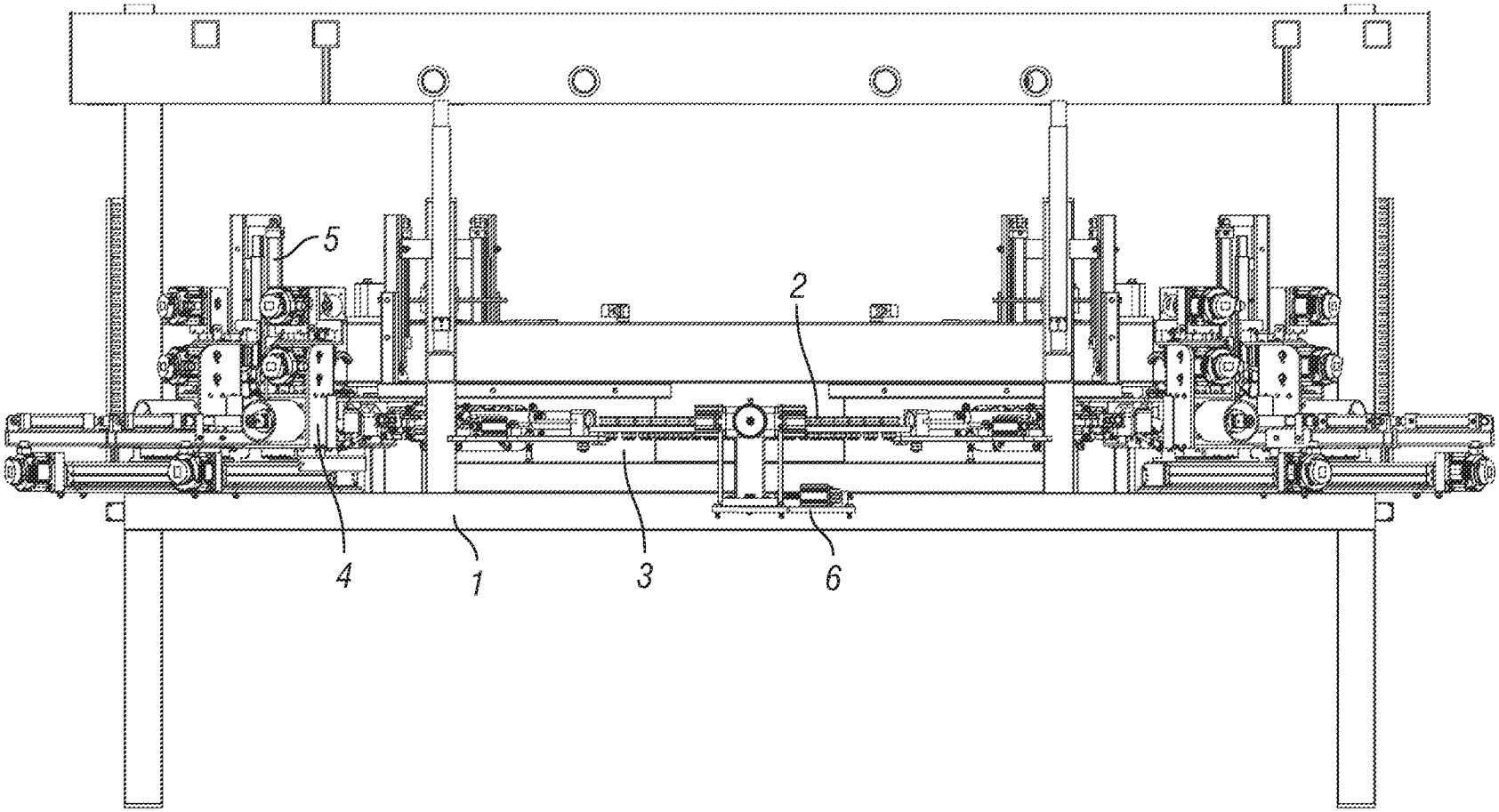
FIG. 2 is a front view of the automated coiling system of FIG. 1.
Figure 3:
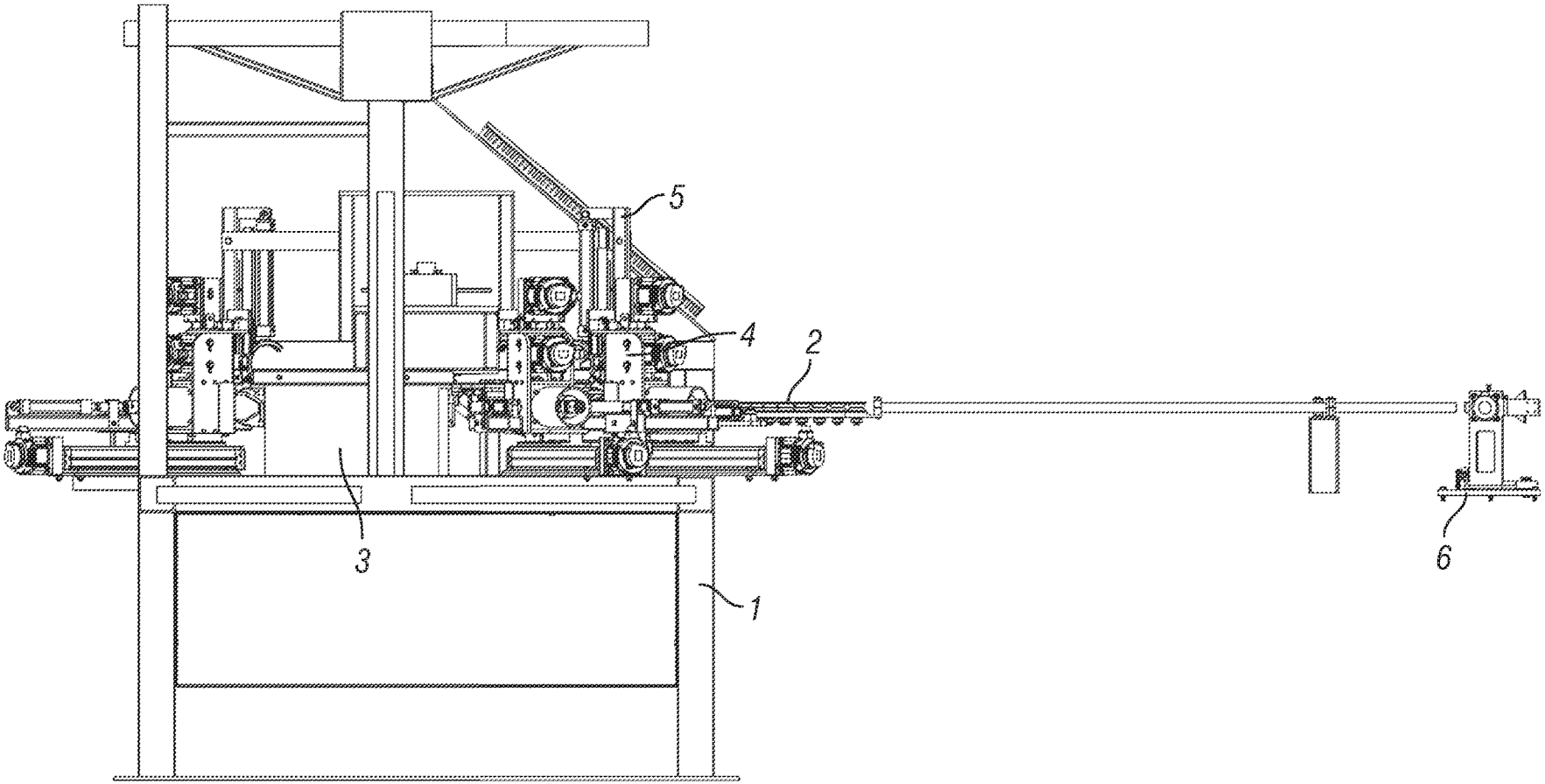
FIG. 3 is a left side view of the automated coiling system of FIG. 1.
Figure 4:
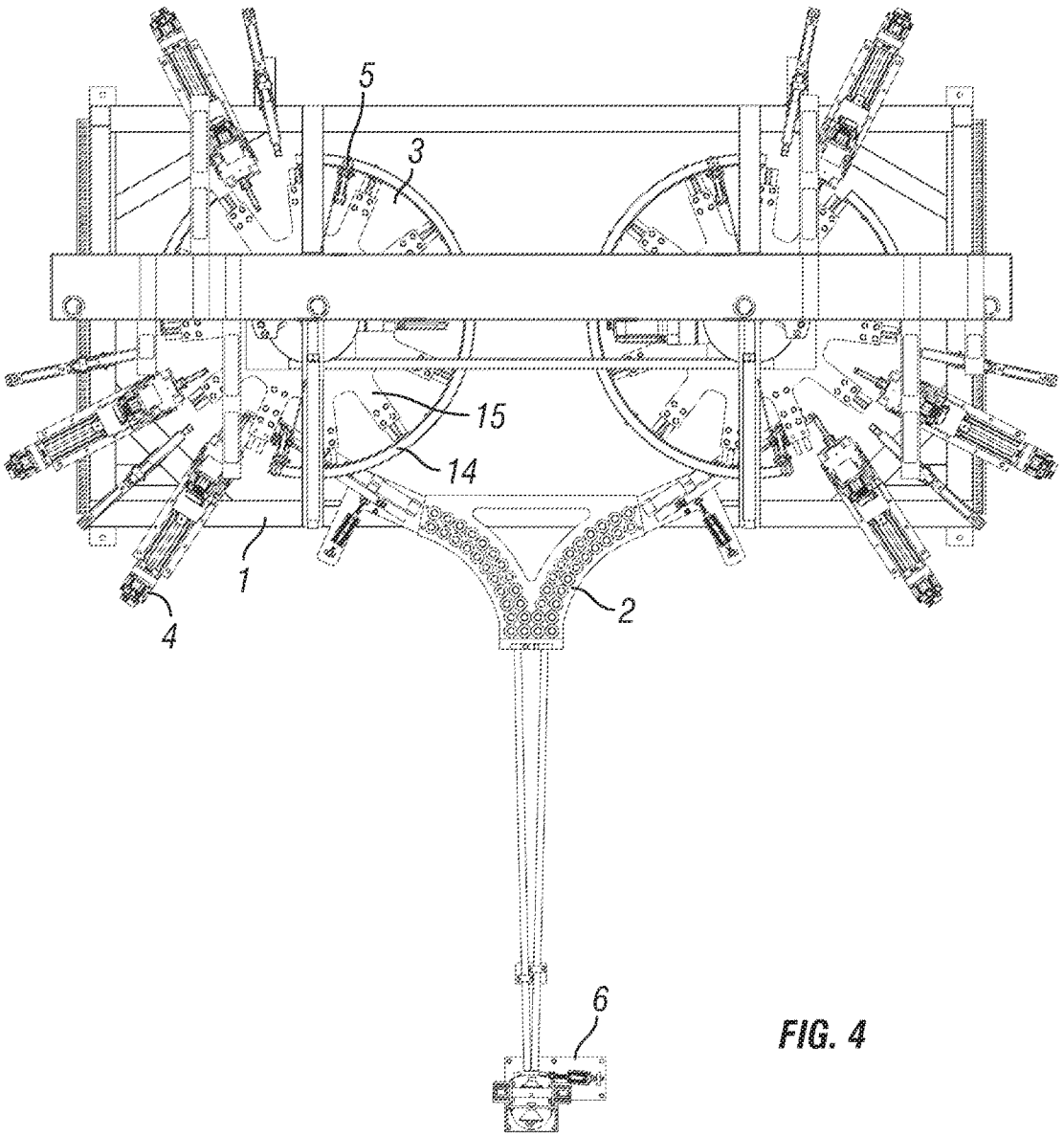
FIG. 4 is a top view of the automated coiling system of FIG. 1.

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by any appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

As will be further described below with respect to the preferred embodiment, the present invention is an automated coiling system for preparing tendons used for post-tensioning reinforcement of concrete elements (slabs, beams or other members). The system employs devices and methods which automate the cutting, coiling, and tying of such tendons into individual units to then be bundled for delivery to a job site. In the preferred embodiment shown in FIG. 1, the system generally comprises the following main assemblies, each of which will be described in further detail below: (a) a frame 1 for supporting the various mechanical elements and assemblies necessary to producing a coiled and tied tendon; (b) a tendon feed system 2 for introducing a tendon into the coiler assembly 3; (c) a coiler assembly 3 for gripping the tendon and coiling it within a fixed skirt having a predefined diameter; (d) a plurality of wire tying subassemblies 4 for securely tying the tendon bundle of varying diameter and cutting the wire after tying; and (e) a tendon ejector system 5 for dropping the tendon onto a platform for retrieval.

In FIG. 1, as well as in the other illustrations, the numerous electrical and communication lines which supply power and transmit data are removed for clarity in understanding the mechanical operation and process steps for producing a coiled and tied tendon bundle. Such lines are well understood to those of ordinary skill in this field and are not required to be shown in order to comprehend the structural and functional advantages of the invention. Similarly, in other figures, various frame components and parts are removed to isolate specific subassemblies for clarity in their descriptions. Also, the preferred embodiment of FIG. 1 depicts two identical tendon coiling and tying systems (left side and right side) supported by the frame 1, both of which are supplied with tendons by the same tendon feed system 2 as will be further described. Therefore, it should be understood that descriptions of the left side system apply equally to the right side system.

Post-tension tendons are constructed from tendons that are comprised of braided steel wires, coated with a friction reducing and corrosion preventative coating and enclosed within a continuous plastic sheath, and formed into large spools for later use. For any particular concrete element requiring post-tension reinforcement, the design engineers will specify the number, length, and features of the post-tension tendons for that job. Thus, individual tendons of widely varying lengths which are bundled by the present invention are cut to the proper length by a cutting device (not shown, but positioned before the diverter assembly 6) after a predetermined length of tendon is fed through the tendon feed system 2 and coiler assembly 3. Tendon material from the supply spool is pushed through the tendon feed system 2 by a roller drive system (not shown) that is set to feed a precise, but widely varying, length of tendon prior to being cut.

The tendon feed system 2 is provided with a diverter assembly 6 which diverts the tendon feed to either the left side or right side coiler assemblies 3. The diverter assembly 6 includes a tendon guide 9 mounted on a pivoting base 7 which partially rotates in a horizontal plane around pivot point 8. In this manner, the diverter assembly 6 is selectively moved to one of the two positions leading to either the left side or right side coiler assembly 3. For example, once a tendon has completely entered the left side coiler assembly 3, the diverter assembly 6 is moved to the other position so that a tendon can immediately be fed into the right side coiler assembly 3. Thus, the coiling of the right side tendon can commence while the left side tendon is being tied and dropped onto the platform for pickup by workers. In a production environment, tendons are successively and alternately fed into the left and right side coiling assemblies 3. For each side, a guide tube 9 is supported and connected to a plurality of opposing guide rollers 10 which are mounted to a roller base plate 11. The guide rollers 10 retain and guide the pushed tendon through a pivoting tube 12 until the tendon reaches a mechanical stop within the coiler assembly 3. At this time, the tendon is gripped by a clamp mounted to the coiler disk 15 so that it can be pulled into the coiler assembly 3 for coiling and tying.

Figure 6:
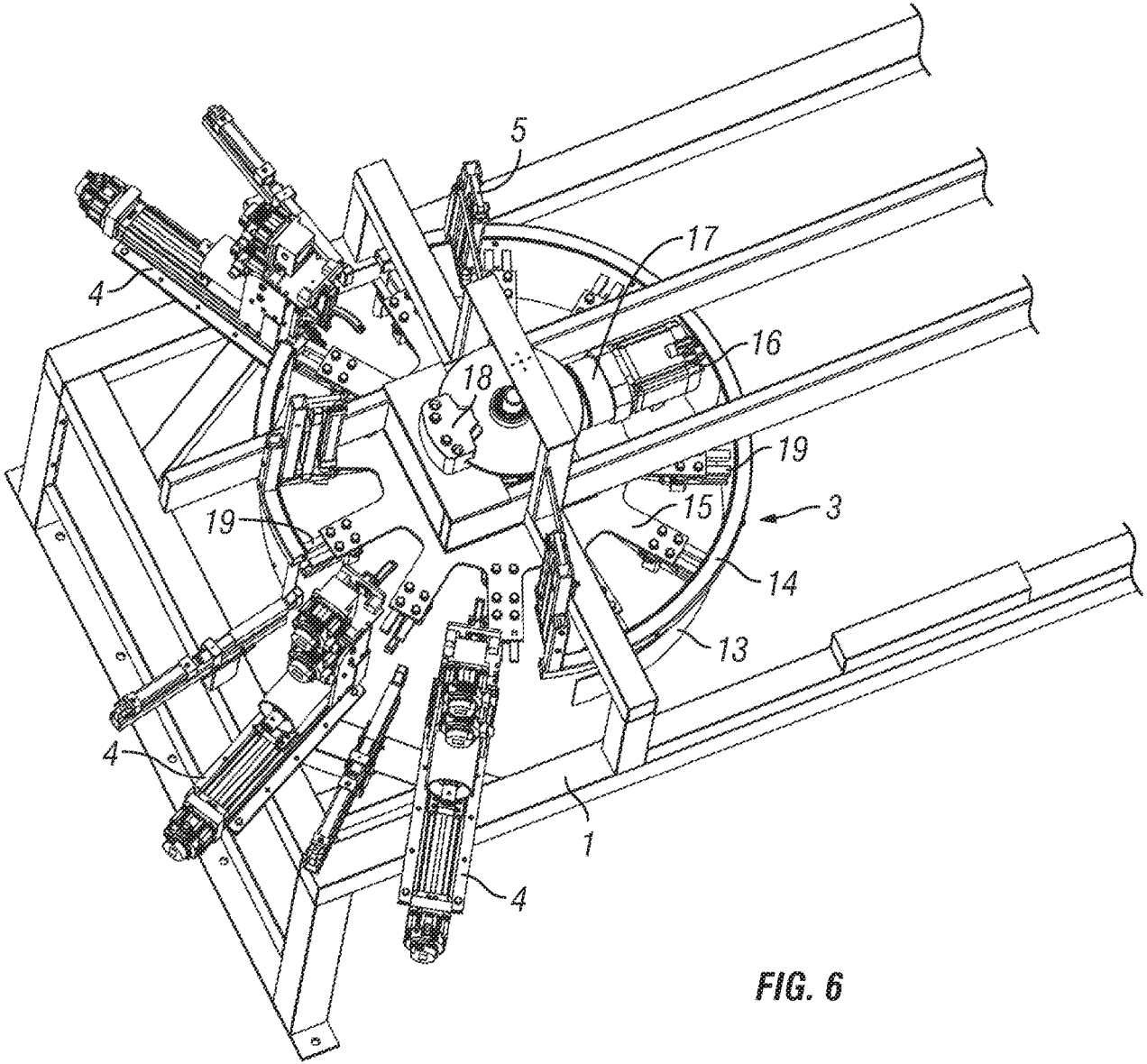
FIG. 6 is a perspective view of the left side coiler and tying components.
Figure 7:
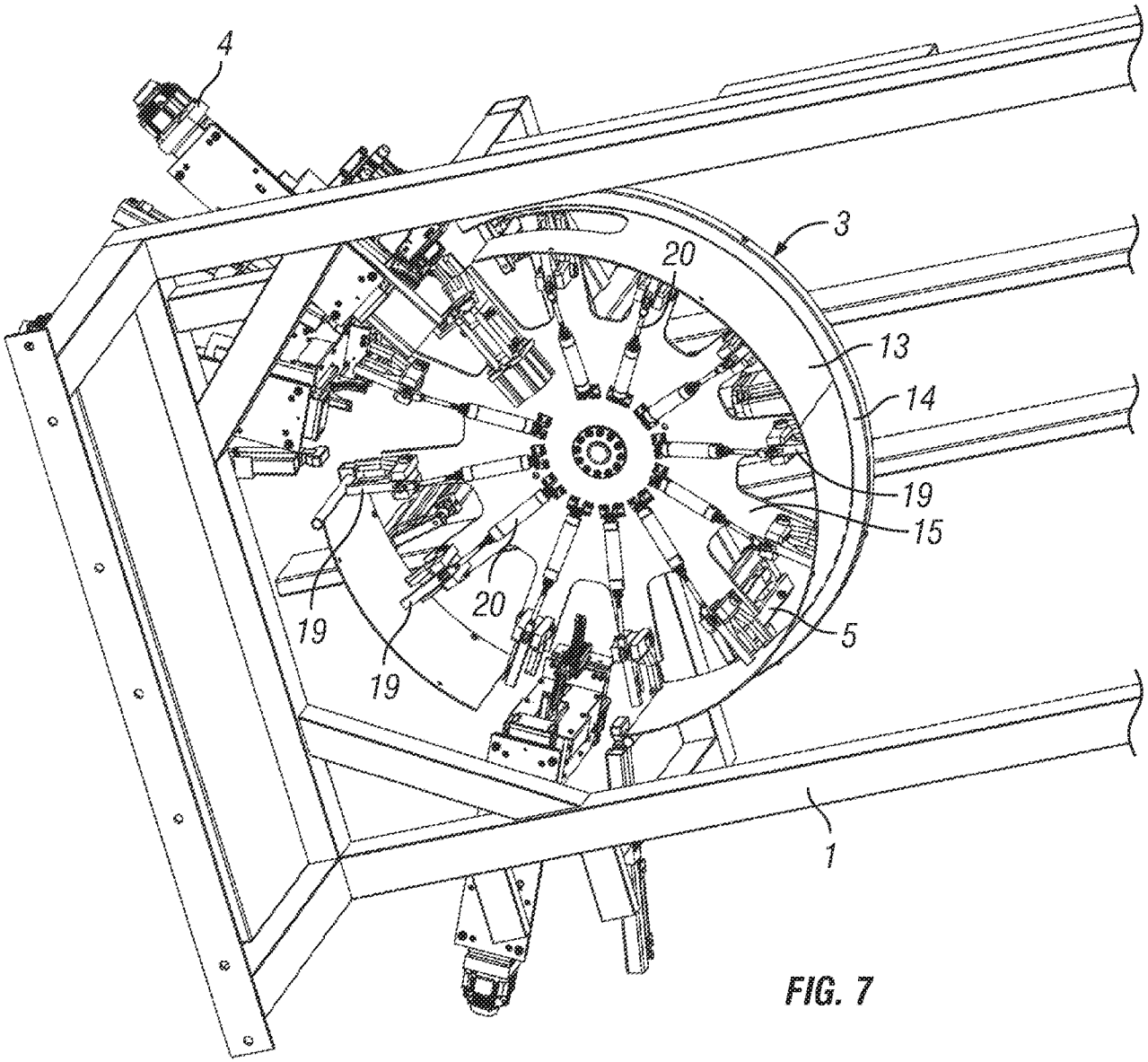
FIG. 7 is an underside view of the coiler and tying components.

As shown best in FIGS. 6 and 7, the coiler assembly 3 comprises a fixed skirt plate 13 bolted to a skirt stiffener frame 14 which is mounted to the frame 1. The skirt plate 13 provides an outer guide for the tendon as it is being coiled. A coiler disk 15 rotates within the skirt plate 13, and is driven by a coiler motor 16 and gearbox 17 mounted to the frame 1. A disc brake system 18 resides above the gearbox 18 to slow or stop the rotation of the coiler disk 15 at the appropriate time during the coiling step. For retaining the coiled tendon, and as best shown in FIG. 7, the coiler disk 15 includes a plurality of tendon holders 19 mounted to the underside of the coiler disk 15, wherein each tendon holder 19 is a U-shaped member that remains in a horizontal position during the coiling and tying step. Once the tendon is tied, all of the tendon holders 19 are caused to rotate downward by operation of a plurality of double-acting air cylinder and rod actuators 20 which are mounted to the underside of the coiler disk 15, allowing the tied tendon bundle to be released to a lower platform by the tendon ejectors 5. Between each of the tendon holders 19, the coiler disk 15 includes recessed areas which accommodate movement of the tying subassemblies toward the tendon bundle and space for the tying components to operate freely as will be described below.

Figure 5:
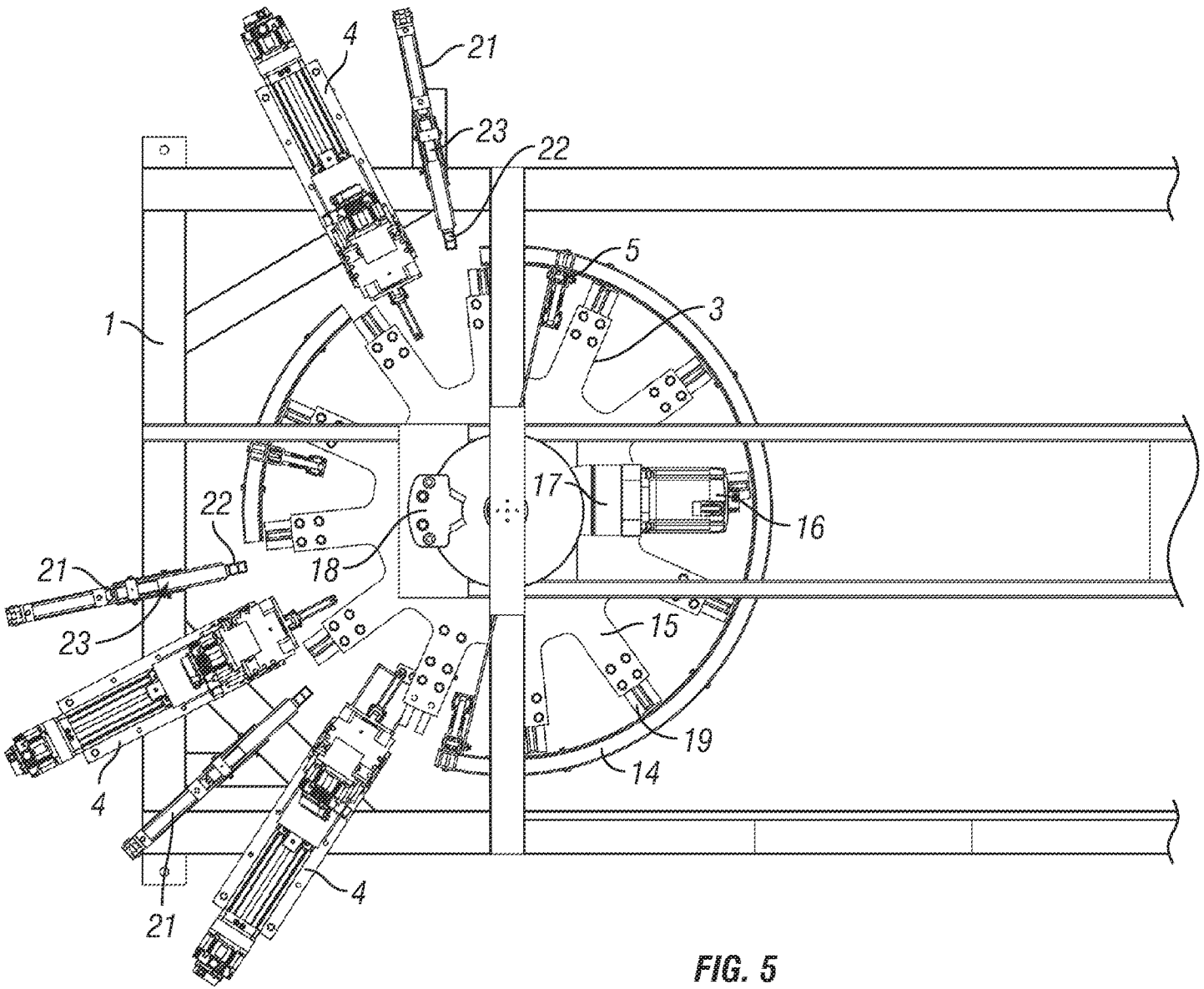
FIG. 5 is top view of the left side coiler and tying components.
Figure 8:
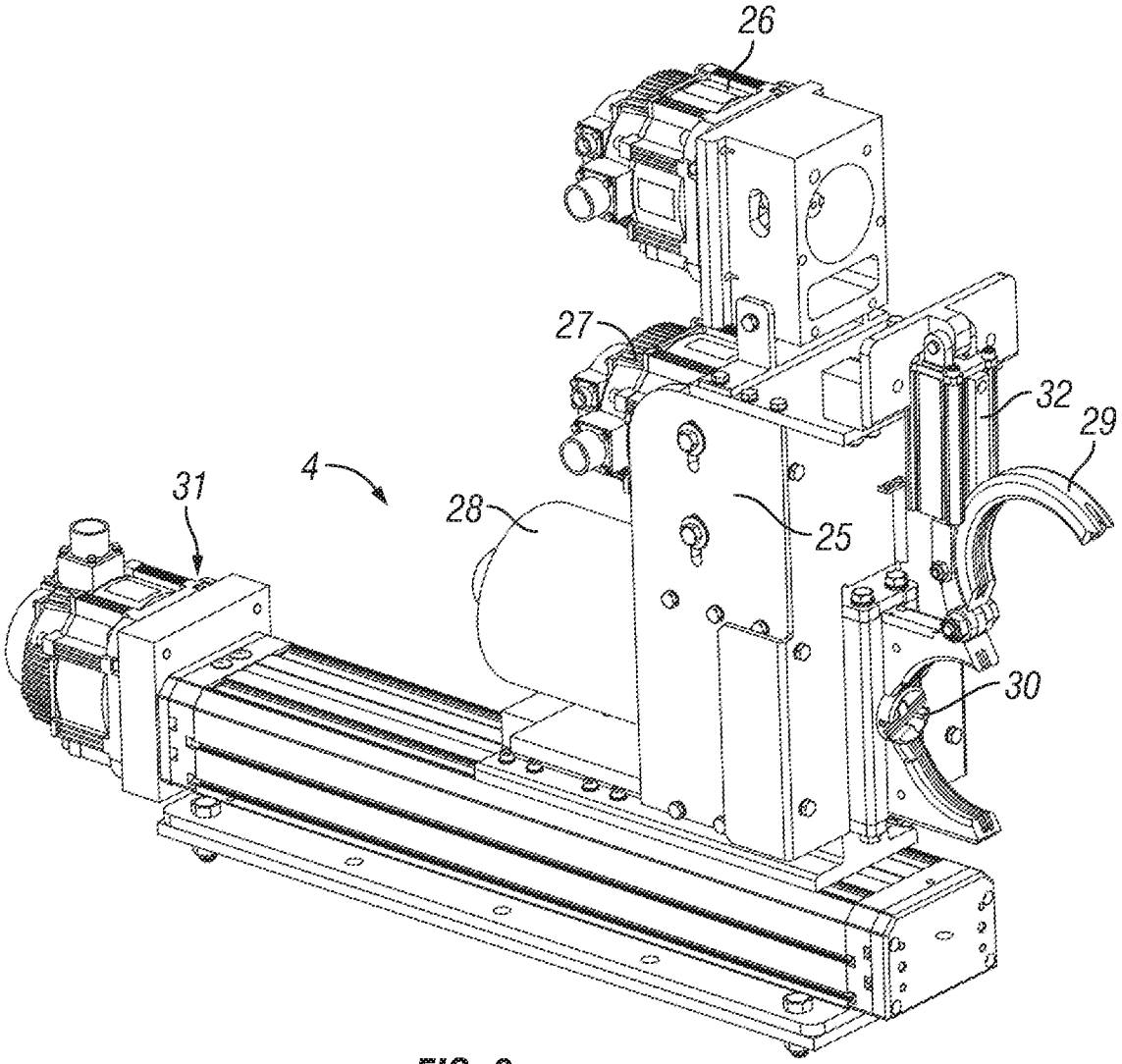
FIG. 8 is an isolated view of a tying assembly and its linear motor.

To keep the varying length tendon bundle securely coiled for delivery to the job site, the fluctuating diameter tendon bundles are tied using a stiff wire at multiple locations around the bundle. The present invention automates this task by providing at least three wire tying subassemblies 4 positioned on the frame 1, and which interact with the different diameter tendon bundle when the coiler disk 15 is properly indexed relative to the tiers 4. A detailed view of the tier 4 is depicted in FIG. 8. As shown in FIG. 5 in a top view, two tiers 4 are located adjacent to one another, while a third tier 4 is located at another desired location. Thus, when the coiler disk 15 stops its rotation, the tendon bundle can be simultaneously tied in three locations around the bundle.

Once the three initial wires have been applied to the tendon bundle, the coiler disk 15 is rotated approximately 180 degrees, so that the tendon bundle can be tied in up to three additional locations, for a total of up to six tied wires around the tendon bundle. Next to each of the tiers 4 is a tendon hold down device 21 for pushing on the tendon bundle during the tying step to urge the varying length tendon into a tight diameter at each tying location for maximum tying effectiveness. The tendon hold down device 21 includes a pushing head 22 at the end of an air cylinder and rod device 23. Thus, as each tier 4 moves toward to the tendon bundle, the tendon hold down device 21 moves toward the tendon bundle at the same time compressing the tendon bundle into a tight diameter and remains in place until the tying step is complete, after which the pushing head 22 is retracted.

With reference to FIG. 8, a detailed view of the tier 4 is shown to comprise a tying head 25 having a wire feeding motor 26, a twisting motor 27, a twisting head 28, a tying ring assembly 29, and a twisting hub 30. The tying head 25 is slidably attached to a linear motor assembly 31 which moves the tying head 25 toward the tendon bundle for tying, and then retracts the tying head 25 away from the tendon bundle after the wire is tied, twisted, and cut around the varying diameter tendon bundle. As the tying head 25 approaches the tendon bundle, the tying ring 29 is caused to close around the tendon bundle by an actuator 31. At this point, the wire feeding motor 26 feeds the wire through the tying ring 29, such that the wire encircles the widely varying diameter of the tendon bundle two times. Immediately after the wire is wound around the tendon bundle, the wire is clamped on one end, excess wire is pulled back, and then the twisting motor 27 causes the twisting head 28 and the attached twisting hub 30 to rotate, twisting the wire and tightening the wire against the tendon bundle. This twisting operation then cuts the wire after twisting against a cutting surface of the twisting hub 30, and the tying ring 29 opens so that the entire tying head 25 can be retracted from the tendon bundle by the linear motor assembly 31.

Figure 9:
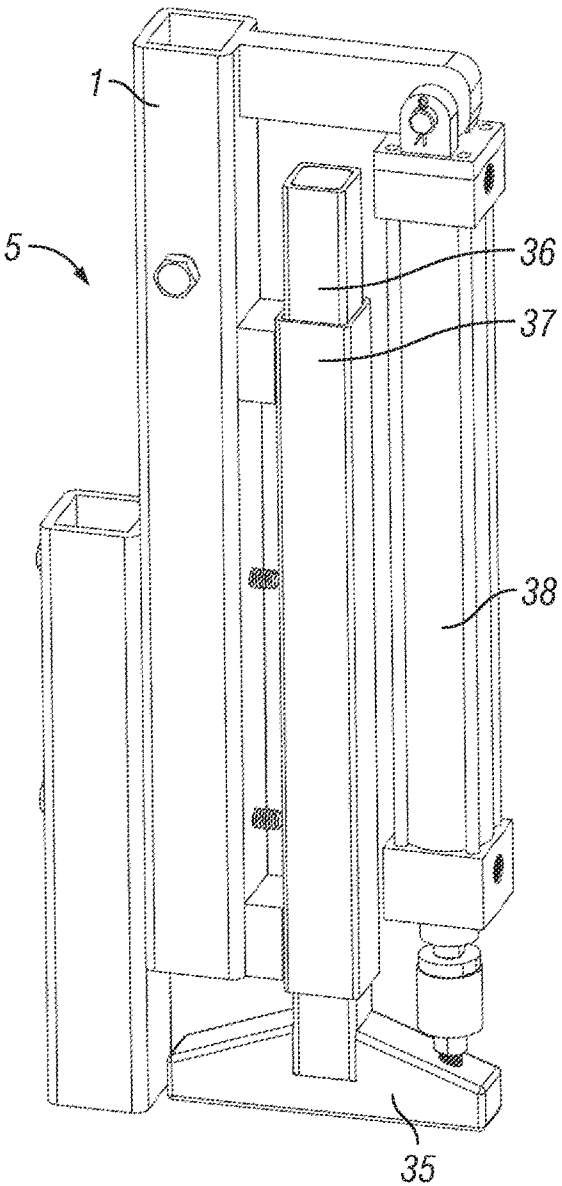
FIG. 9 is an isolated view of a tendon ejector assembly.
Figure 10:
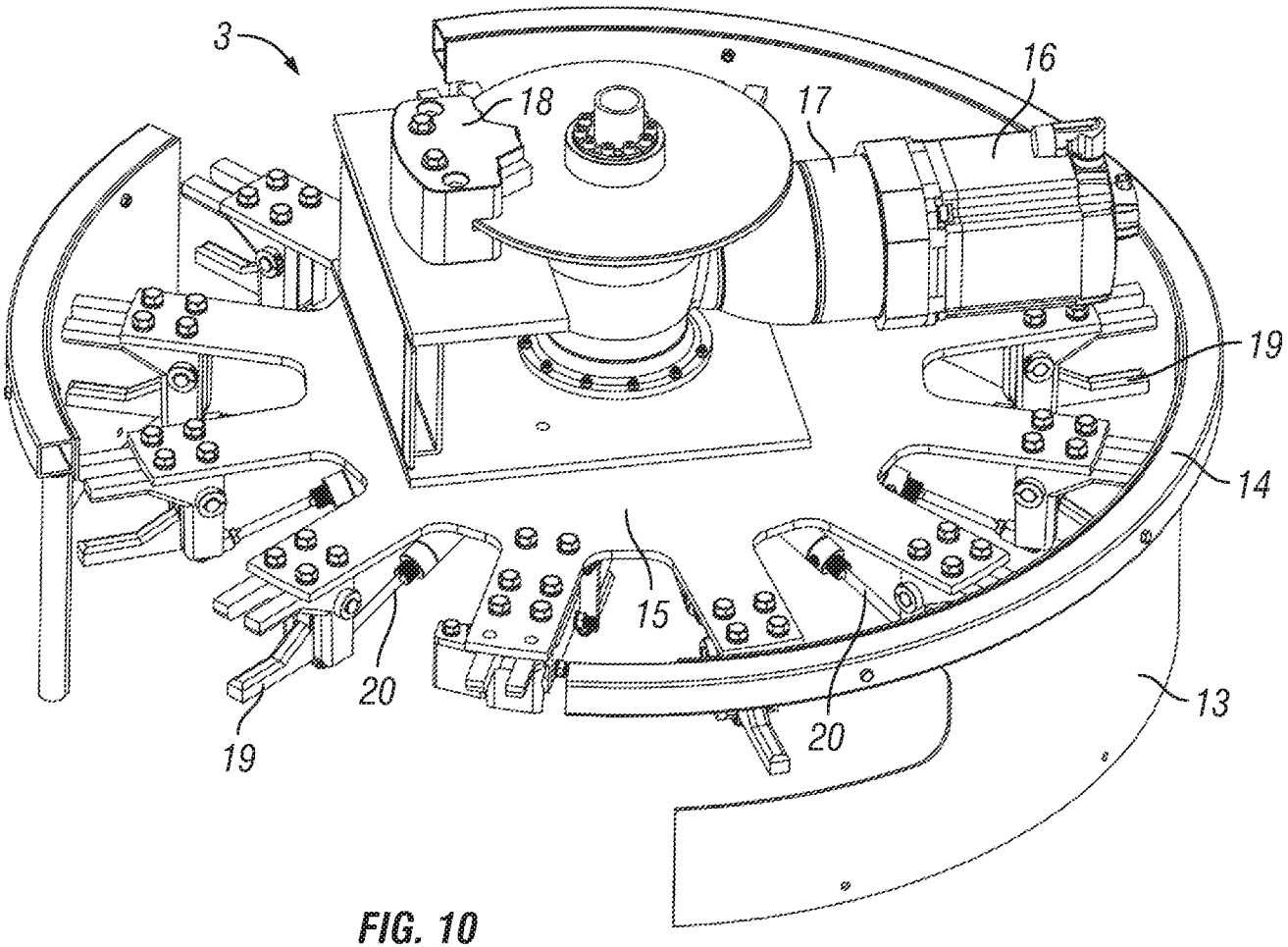
FIG. 10 is an isolated view of the coiler plate assembly, showing the skirt, the motor and brake, and gearbox.
Figure 11:
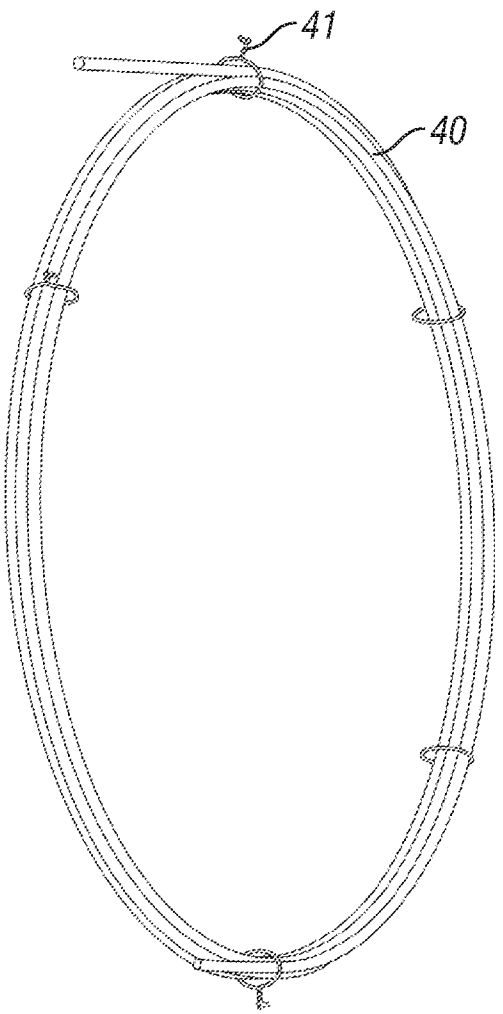
FIG. 11 is a view of a post-tension tendon coiled and tied by the present invention.

With reference to FIG. 9, a detailed view of the tendon ejector 5 is shown to comprise an ejector head 35 attached to a slidable rod 36, and which moves within a guide sleeve 37 affixed to a member of the frame 1. The slidable rod 36 and ejector head 35 are caused to move downward by an ejector actuator 38 once the U-shaped tendon holders 19 have been rotated downward by their respective actuators 20. All of the tendon ejectors are employed in the preferred embodiment, although an alternate number may be used depending on the engineering dynamics of the situation.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. An automated coiling system for post-tension tendons, comprising:

(a) a frame;

(b) a tendon feed device adapted to introduce a tendon into a coiler assembly;

(c) a coiler assembly mounted on the frame and adapted to grip and coil the tendon to form a tendon bundle having a predefined coil diameter;

(d) a diverter assembly positioned on the tendon feed device to selectively direct the tendon to either the coiler assembly or a second coiler assembly;

(e) a plurality of wire tying devices mounted on the frame and adapted to securely tie a wire around the tendon bundle in a plurality of predetermined positions and cut the wire after tying, wherein the wire tying device includes a rotatable twisting device to form a twisted tying wire around the tendon bundle; and (f) a tendon ejector device mounted on the frame and adapted to urge the tendon bundle from the coiler assembly.

2. The coiling system of claim 1, wherein the coiling assembly includes a skirt plate having a shape and dimensions sufficient to assist in forming the tendon into a coil having the predefined coil diameter.

3. The coiling system of claim 2, wherein the coiler assembly includes a coiler disk sufficient to grip the tendon and urge the tendon around the skirt plate.

4. The coiling system of claim 3, wherein the coiler assembly includes a coiler motor to rotate the coiler disk, and a braking device to stop rotation of the coiler disk at one or more predetermined rotational positions.

5. The coiling system of claim 3, wherein the coiler disk includes a plurality of rotatable U-shaped tendon holders.

6. The coiling system of claim 5, wherein the tendon holders are rotatable between a first position of holding the tendon bundle and a second position of releasing the tendon bundle.

7. The coiling system of claim 3, wherein the coiler disk includes a plurality of recessed areas sufficient to permit one or more of the wire tying devices to approach and tie the tendon bundle.

8. The coiling system of claim 1, further including one or more tendon hold-down devices mounted on the frame and adapted to push the tendon bundle into a more compact configuration for tying.

9. The coiling system of claim 1, wherein the wire tying device includes:

(a) a tying frame having a tying ring for enclosing the tendon bundle;

(b) a wire feed device for feeding a tying wire through the tying ring; and (c) the twisting device mounted to the tying frame for twisting and tightening the tying wire around the tendon bundle, wherein the twisting device includes a cutting device for cutting the tying wire once it has been tightened around the tendon bundle.

* * * * *